United States Patent [19]

Ramacciotti

[11] 4,054,445

[45] Oct. 18, 1977

[54] DEOXIDIZING AND DESULPHURIZING STEEL

[75] Inventor: Aldo Ramacciotti, Rome, Italy

[73] Assignee: Centro Sperimentale Metallurgico S.p.A., Rome, Italy

[21] Appl. No.: 725,857

[22] Filed: Sept. 23, 1976

[30] Foreign Application Priority Data

Sept. 26, 1975 Italy ..... 51517/75

[51] Int. Cl.[2] ..... C21C 7/10; C21C 7/02; C21C 7/06

[52] U.S. Cl. ..... 75/49; 75/53; 75/55; 75/58

[58] Field of Search ..... 75/49, 53, 55, 58

[56] References Cited

U.S. PATENT DOCUMENTS

| | | | |
|---|---|---|---|
| 3,467,167 | 9/1969 | Mahin | 75/49 |
| 3,980,469 | 9/1976 | Forster | 75/49 |

*Primary Examiner*—P. D. Rosenberg
*Attorney, Agent, or Firm*—Young & Thompson

[57] ABSTRACT

Unkilled steel is transferred, substantially without slag, from the refining reactor to a degassing reactor. The pressure in the degassing reactor is reduced to not more than 200 mm. Hg, and calcium carbide is added in a quantity such that calcium added is from 1 to 2 kg. per ton of steel. A vacuum is maintained for 10 to 20 minutes and then released. Preferably, the calcium carbide additive contains 5 to 25% by weight of calcium fluoride.

2 Claims, No Drawings

DEOXIDIZING AND DESULPHURIZING STEEL

The present invention relates to deoxidizing and desulphurizing steel.

Specifically, it has been discovered that steel can be simultaneously deoxidized and desulphurized by adding thereto calcium carbide as a reducing agent and operating in a vacuum.

The use of calcium carbide has previously been known in various steelmaking operations. For example, calcium carbide is currently used in electric and other types of steel furnaces for reducing slag; and it is also added for this purpose to the molten steel in the ladle whenever carburization of the bath is required or can be tolerated within certain limits.

Calcium carbide has a strong desulphurizing power in air, provided the bath has previously been killed with aluminum, silicon or other strong deoxidant.

When calcium carbide is added to molten steel in a vacuum according to the present invention, it acts as a strong combined deoxidizer and desulphurizer without any need for further additives and with very little or no danger of recarburization taking place.

The invention is practiced by the performance of the following steps:

1. Unkilled steel is transferred, substantially without slag, from the refining reactor to a conventional degassing reactor.

2. The internal pressure of the degassing reactor is reduced to a value which is at most 200 mm. Hg.

3. Calcium carbide is added in a quantity such that the calcium is present from 1 to 2 kg. per ton of iron.

4. This treatment is continued for 10 to 20 minutes. The degassing reactor is then permitted to return to atmospheric pressure and the steel is teemed.

Calcium carbide can be added to the charge in any convenient physical form, finely divided or otherwise. Excellent results are obtained when the calcium carbide material contains admixed therewith from 5 to 25% by weight of the charge of calcium fluoride, which may be in the form of fluorite. of fluorite.

The present invention has the following very advantageous features:

1. Reaction between the carbon of the calcium carbide and the oxygen of the steel is favored, for thermodynamic reasons, by the reduction in pressure. Operating in a vacuum, the chances that the calcium will compete with the carbon in the recarburization process are greatly reduced.

2. The violent agitation to which the bath is subjected when the internal pressure of the reactor is lower, facilitates contact between the constituents taking part in the deoxidizing and desulphurizing reactions, thereby greatly reducing the reaction time.

3. Substantially no slag is present in the degassing reactor and the calcium carbide can accordingly proceed to deoxidize and desulphurize the molten steel at once. By contrast, for example, in an electric furance, calcium carbide poured in on top of the slag would have to reduce the latter completely before it could act on the steel.

Repeated testing of the invention as shown that, with his method, as much as 90% of the sulphur can be removed.

In order to enable those skilled in this art to practice the invention, the following illustrative example is given:

EXAMPLE

A 100 kg. sample of effervescent steel having the following composition (percent by weight): C = 0.075; Si = 0.026; Mn = 0.26; S = 0.030; P = 0.007; O = 0.018; balance essentially iron, was melted and then subjected to deoxidation-desulphurization according to the present invention.

Specifically, the molten steel was transferred from the refining reactor to a degassing reactor by immersing a tube in the molten steel in the refining reactor at a distance below the slag, and withdrawing the steel by vacuum through the tube, with substantially no slag, and then introducing the withdrawn steel into a conventional degassing reactor. The internal pressure of the degassing reactor was lowered to 200 mm. Hg. A calcium carbide charge, having a particle size from 1 to 10 mm. and containing 90% by weight calcium carbide and 10% by weight calcium fluoride, was then added in a quantity such that there was 1.3 kg. calcium present per ton of steel. After 20 minutes, the vacuum was released and the space above the bath returned to normal atmospheric pressure.

Upon testing the resulting steel, it was found that the carbon was 0.070%, the sulphur 0.01% and the oxygen 0.01%, the other constituents remaining substantially unchanged. Thus there were very substantial reductions in the oxygen and sulphur percentages, without much change in the original carbon content of the steel.

Although the present invention has been described and illustrated in connection with a preferred embodiment, it is to be understood that modifications and variations may be resorted to without departing from the spirit of the invention, as those skilled in this art will readily understand. Such modifications and variations are considered to be within the purview and scope of the present invention as defined by the appended claims.

I claim:

1. A process for deoxidizing and desulphurizing steel, comprising transferring the unkilled steel substantially free from slag from a refining reactor to a degassing reactor, reducing the internal pressure of the degassing reactor to not more than 200 mm. Hg, adding to the molten steel in the degassing reactor calcium carbide in an amount such that the calcium therein is from 1 to 2 kg. per ton of steel, and maintaining the reduced pressure within the degassing reactor for 10 to 20 minutes.

2. A process as claimed in claim 1, in which the calcium carbide is introduced in the form of a mixture containing 5 to 25% calcium fluoride by weight of the mixture.

* * * * *